United States Patent [19]

Brüggemann et al.

[11] 4,456,035

[45] Jun. 26, 1984

[54] METHOD OF MAKING DOUBLE-SIDED TEXTILE MATERIAL AND TEXTILE MATERIAL PRODUCED THEREBY

[75] Inventors: Werner Brüggemann, Krefeld; Heinrich Laus, Grefrath, both of Fed. Rep. of Germany

[73] Assignee: Girmes-Werke AG, Fed. Rep. of Germany

[21] Appl. No.: 355,397

[22] Filed: Mar. 8, 1982

[51] Int. Cl.[3] ..... D03D 27/10; D03D 39/18

[52] U.S. Cl. ..... 139/398; 139/21

[58] Field of Search ..... 139/407, 398, 397, 391, 139/21, 291 C, 403, 405; 428/92, 93, 94

[56] References Cited

U.S. PATENT DOCUMENTS

| | | | |
|---|---|---|---|
| 484,541 | 10/1892 | Pearson | 139/398 |
| 484,605 | 10/1892 | Pearson | 139/398 |
| 1,143,804 | 6/1915 | Binz | 139/398 |
| 2,333,258 | 11/1943 | Lambert | 139/398 X |
| 3,499,471 | 3/1970 | Kuny | 139/398 X |

FOREIGN PATENT DOCUMENTS

| | | | |
|---|---|---|---|
| 20908 | of 1897 | United Kingdom | 139/398 |

*Primary Examiner*—James Kee Chi

*Attorney, Agent, or Firm*—Merchant, Gould, Smith, Edell, Welter & Schmidt

[57] ABSTRACT

A double plush weaving operation is conducted to form a two-ply material with pile yarns connecting the two plies together. Each ply comprises an outer woven layer and an inner pile-carrying layer. The two layers are tied together by warp yarns but the pile yarns are tied in only to the pile-carrying layer so that the tying-in points are not visible on the outer visible surface of the woven layer. The connecting pile yarns are cut to form two lengths of double-sided fabric with the plush side having satisfactory pile strength and the woven side having the appearance of a flat weaving machine product.

11 Claims, 2 Drawing Figures

METHOD OF MAKING DOUBLE-SIDED TEXTILE MATERIAL AND TEXTILE MATERIAL PRODUCED THEREBY

FIELD OF THE INVENTION

The invention relates to a method for making double-sided textile material, especially for outerwear garments such as coats, jackets, capes, anoraks and the like.

BACKGROUND OF THE INVENTION

It is known to make double-sided textile material for outerwear purposes, such material having a cloth-like or suede-like appearance on one side and a plush surface on the other. Such material has not however, hitherto appeared on the market to any great extent in forms made according to current technology since it has serious disadvantages.

The disadvantages arise from the difficulty of making such material with the points where the pile naps are tied in satisfactorially concealed from view. Attempts have been made to cover the tying-in points by measures such as vigorously "roughening" the non-plush surface, lining with covering sheets or Velveton (velveteen), or applying coatings of, for example, polyvinyl chloride or polyurethane. With these procedures, however, the textile "handle" and the "fall" of the material generally suffer.

Attempts have also been made to cover the pile nap tying-in points in a bonding manner with the aid of strongly "floating" threads on the non-plush side of the fabric. These measures resulted, however, in insufficient nap strength, a disadvantage that occurs especially in the case of fairly long pile yarns.

SUMMARY OF THE INVENTION

The object of the invention is to make a double-sided textile material with a plush side and a cloth-like or suede-like side in which the tying-in points of the pile naps are effectively and permanently covered, without weakening the pile strength or the strength of the textile material itself and whilst retaining the textile handle and the natural fall of textile articles made therefrom.

According to the invention, this method for making double-sided textile material, especially for outerwear garments, having the appearance of a flat weaving machine product covering all qualities that can be obtained from warp and weft, wherein the outer side can have a cloth-like or suede-like surface, characterised in that a double-plush article is made according to the double-plush weaving method, both of whose plies joined by the pile yarns are double-layered with local mutual tying, and the pile yarns are only tied into one layer, following which the pile yarns are cut in order to separate the two plies.

DETAILED DESCRIPTION OF THE INVENTION

It has been found that it is possible by pure weaving to make a double-sided textile material suitable for outerwear garments, which has on one side a cloth-like or suede-like appearance of a quality not hitherto achieved, and which has on the other side a plush surface of satisfactory pile strength with all its possibilities of variation. In order to make such textile material, conventional double plush weaving looms (shuttle or looper) can be used, and the side with the cloth-like or suede-like appearance can for example be woven with a linen binding. Since both sides of the material are in fact made at the same time but form individual layers, the layer serving as carrier for the pile naps or pile fibres can be produced, like the other layer, from other material and also with another binding.

The textile material made according to the invention consists of two layers each of which can be formed corresponding to its desired function, uninfluenced by the other layer. Thus, the layer having the cloth-like or suede-like appearance can be made from a high quality and if necessary very fine material, while the other layer may be formed from a cheaper material which, although ensuring a good and reliable tying-in of the pile naps, need not necessarily have a corrsponding appearance. Since the two layers can be joined by floating tying-in of the warp threads of the layer having the cloth-like or suede-like appearance, no parts or threads of the other layer need be visible on the side of the material having the cloth-like or suede-like appearance, and similarly the pile nap tying-in sites are not visible on this side. Subsequent treatment such as roughening, or coating with materials that affect the textile handle and fall, is not necessary. Instead, the material can be made on a double plush weaving loom in a single work stage, and is then ready, after cutting the pile threads, for further processing into clothing pieces.

DESCRIPTION OF THE PREFERRED EMBODIMENTS

An embodiment of the invention will now be described by way of example only, reference being made to the accompanying diagrammatic drawings in which.

Figure 1:
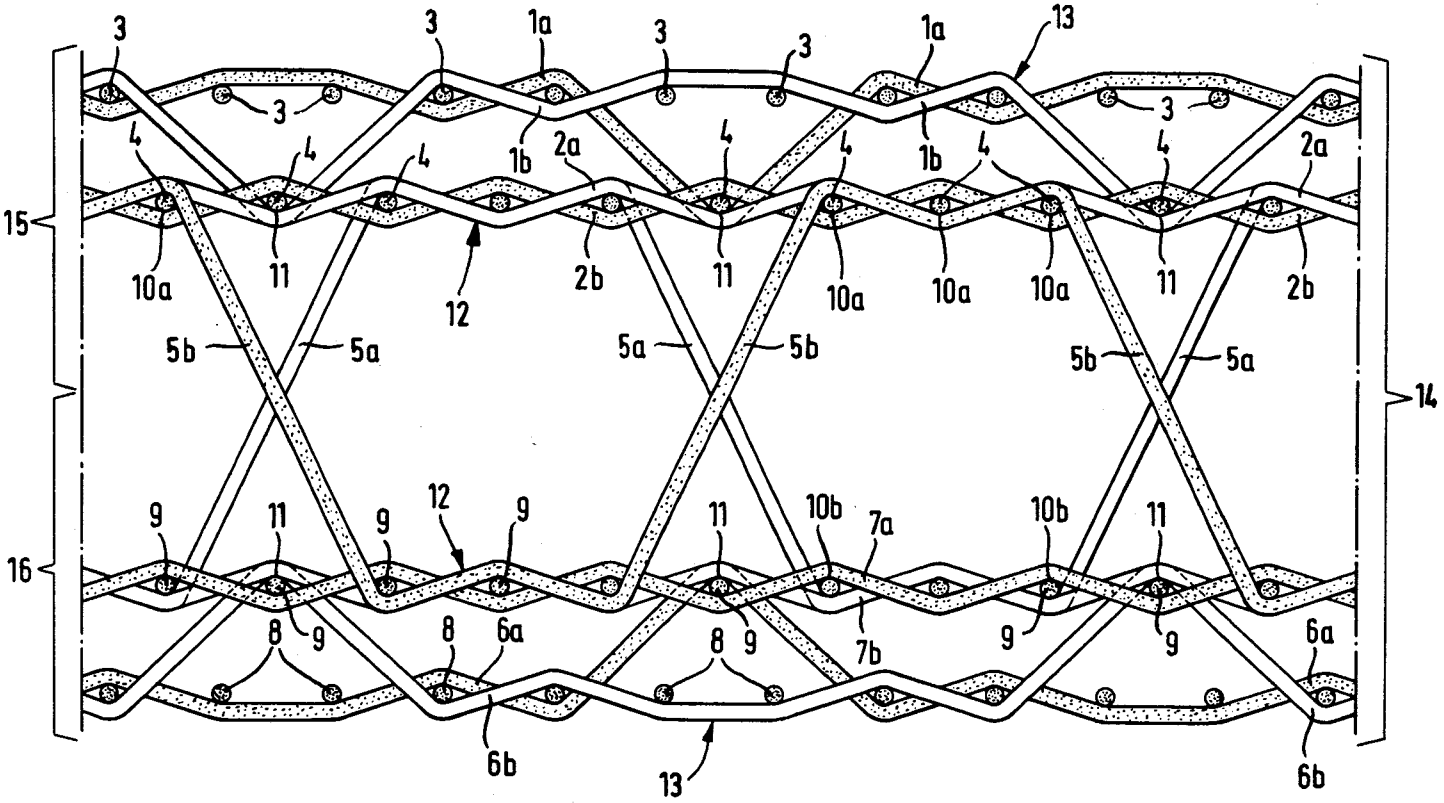
FIG. 1 shows a double-sided textile material made on a double plush weaving machine.
Figure 2:
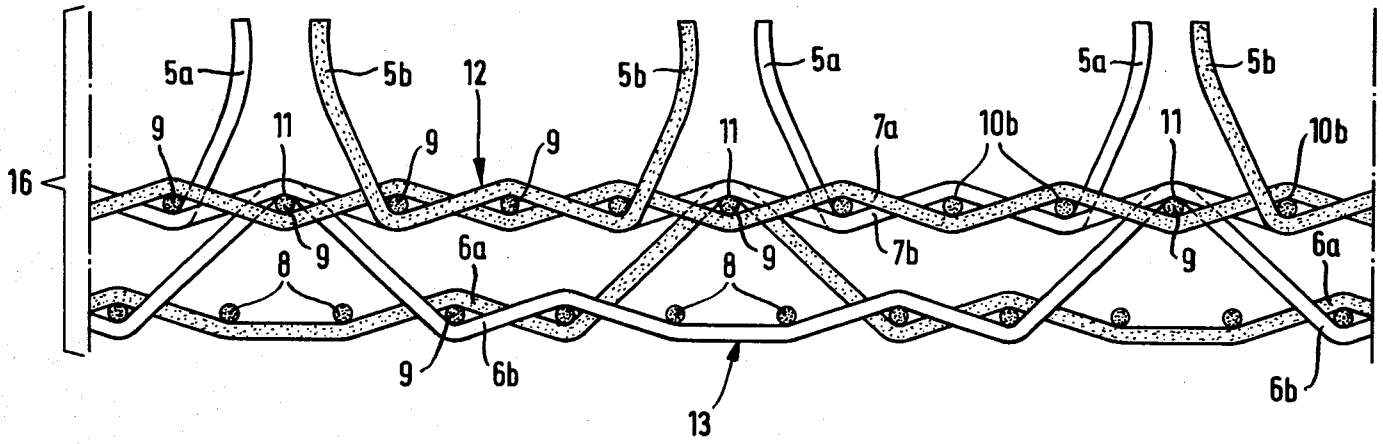
FIG. 2 shows a double-sided textile material produced by cutting a length of the textile material shown in FIG. 1.

According to FIG. 1, a material length 14 made on a double plush weaving loom consists of an upper piece 15 and a lower piece 16 which are joined to one another by means of pile threads 5*a* and 5*b* tied alternately into the upper piece and lower piece.

Both the upper piece 15 and lower piece 16 consist of two superimposed woven layers 13 and 12, each of which is formed in conventional manner from warp threads 1*a* and 1*b*, 2*a* and 2*b*, 6*a* and 6*b* and 7*a* and 7*b*, and weft threads 3 and 4 and 8 and 9.

The material length 14 can be made on a double-shuttle weaving loom or a double-gripper weaving loom using single shuttle weaving techniques, with a weft for the upper piece and a weft for the lower piece (ie. four foundation fabrics are made according to single-shuttle weaving techniques, the inner woven layers 12 being joined to one another by means of the pile threads 5*a* and 5*b*). The outer woven layer 13 is a flat fabric separate from the inner woven layers 12 for the pile threads 5*a* and 5*b*, so that the two layers can be formed independently as regards colour and tying-in. Each pair of layers 12 and 13 is held together by virtue of the fact that the warp threads 1*a*, 1*b*, 6*a* and 6*b* of the layers 13 switch over after certain distances to the respective layer 12 and are there held by weft threads 9. This alternation of the warp threads can be arbitrary. A superficially good join between the layers 13 and 12 is obtained without the layer 12 or parts thereof appearing on the outside of the layer 13. At the same time, the warp threads 1, 1*b*, 6 *a* and 6*b* alternating between the layers 13 and 12 are covered by the plush surface formed by the pile threads 5*a* and 5*b*.

The pile threads 5*a* and 5*b* are tied in a W-manner into the layers 12. It can be seen that the warp threads 1*a*, 1*b*, 6*a* and 6*b* of the outer layer 13 switch over at points between the tying-in sites 10*a* and 10*b* of the pile threads 5*a* and 5*b* into the fabric 12 (ie. the tying-in sites 11 of the warp threads 1*a*, 1*b*, 6*a* and 6*b* of the outer layer 13 lie in the inner layer 12 between tying-in sites 10*a* and 10*b* so that the pile threads 5*a* and 5*b* do not overlap with warp threads 1*a*, 1*b*, 6*a* and 6*b*).

Two warps are also required to make the article, which are guided at different tensions since only in this way can the wefts be superimposed.

The surface appearance of the outer layer 13 is formed by the woven binding, warping, colour, and material in the warp and weft, as in a normal flat fabric. The outer flat layer 13 can thus be made as a plain article and also in stripes, and in any shape and width. The picking can also contribute to the making of the surface structure of the fabric 13. Taffeta, satin, twill, etc., can be used as binding for this purpose.

Both thin and thick weft threads can be worked in using a weft changer, and different materials and threads can accordingly be worked into the individual fabric layers 13 and 12. It is also possible to use smooth and flake yarn in widely differing sequences. All types of cellulose fibres, natural and regenerated wool, natural silk, polyamide, polyester, acrylic and Modacrylic fabrics, including normal and shrunk types, can be used as material for the backing of the flat fabric, and the same is true as regards the pile material. In order to impart a suede-like appearance to the surface of the flat fabric layer 13, yarns made from composite threads, for example threads consisting of individual polyamide and polyester sections, can be split and used as material for the flat fabric layer backing. The woven-in composite threads with their adjacent components can be split up in known manner, for example by treatment with hot water or lightly sanding the fabric surface. Yarns made of extra-fine fibres of an individual fibre fineness of 0.0001 to 0.8 denier are suitable for the aforementioned purpose, as are yarns made from natural silk such as schappe or bourette silk.

The nap length of the cut-up pile threads 5*a* and 5*b* may vary according to the desired appearance of the plush side, and varies between a short velvet length and the long length of a fox skin. Expressed in figures, this means a free length of the pile threads 5*a* and 5*b* between the upper piece 15 and lower piece 16 of 2 mm to 80 mm (and accordingly an overall height of the pile of the cut-up article of 1 mm to 40 mm). The plush side or pile side may be treated antistatically and/or antibacterially; one or both sides of the fabric can be treated with a water repellent.

In the finished article of clothing, the smooth surface of the fabric layer 13 or the plush side may be worn on the inside or outside according to choice.

We claim:

1. A method for making double-sided textile having weft threads, warp threads and pile threads in a pattern, the textile being suitable for use in clothing, wherein a plush surface is provided on a first side and a second side has the appearance of a smooth flat weaving machine product, the method comprising weaving a textile fabric comprising first and second plies, each ply having a first pile-carrying layer connecting together the two plies by pile yarns tied into the pile-carrying layers only, and secondly an outer woven layer tied into a respective pile-carrying layer, the outer woven layer and the respective pile-carrying layer together having no more than 4 warp threads in the pattern and an average of less than one binding at every weft thread in the pattern, and cutting the connecting pile yarns to form said double-sided textile.

2. A method according to claim 1 wherein the outer woven layer of each ply is tied into the pile-carrying layer with appropriate pile connection and appropriate pattern repeat sizes in the pile "through" and pile "up".

3. A method according to claim 1, wherein the outer woven layers are woven and tied in to the pile-carrying layers with their warp threads at constant or varying distances.

4. A method according to claim 1, wherein each outer woven layer and each respective pile-carrying layer are joined by fastening points which fasten the pile-carrying layer to the outer woven layer or vice versa, the individual fastening points being situated at different distances from one another.

5. Double-sided textile material made according to the method of claim 1 and consisting of two layers joined together, wherein one layer is a cloth-like or suede-like fabric and the other layer is a carrier for pile yarns.

6. Textile material according to claim 5, wherein the cloth-like or suede-like fabric with its warp threads is tied in with floating binding into the other layers.

7. Textile material according to claim 6, wherein the warp threads of the cloth-like or suede-like fabric are tied in randomly into the other layer.

8. Textile material according to claim 5, wherein the layer serving as carrier for pile yarns is a fabric different from the other layer.

9. Textile material according to claim 5 wherein the warp threads of the outer woven layer consist of an essentially different material or have another colour composition than the warp threads of the pile-carrying layer.

10. Textile material according to claim 5 wherein the weft threads of the outer woven fabric layer consist of an essentially different material or have another colour composition than the weft threads of the pile-carrying layer.

11. Textile material according to claim 5 wherein the warp material of the pile-carrying layer and outer woven layer is worked in in such a way as to produce desired alternation in the surface of the cloth-like or suede-like fabric.

* * * * *